US006155604A

United States Patent [19]

Greene et al.

[11] Patent Number: 6,155,604

[45] Date of Patent: Dec. 5, 2000

[54] COATINGS AND INK DESIGNS FOR NEGOTIABLE INSTRUMENTS

[76] Inventors: Jonathan D Greene, 8016 Aberdeen Rd., Bethesda, Md. 20814; John J. Byrne, 1200 N. Nash St., Arlington, Va. 22209

[21] Appl. No.: 09/321,197

[22] Filed: May 27, 1999

[51] Int. Cl.[7] ..... B42D 15/00

[52] U.S. Cl. ..... 283/70; 235/491

[58] Field of Search ..... 283/70; 235/491

[56] References Cited

U.S. PATENT DOCUMENTS

| | | | |
|---|---|---|---|
| 3,500,047 | 3/1970 | Berry | 251/71 |
| 4,146,792 | 3/1979 | Stenzel et al. | 250/365 |
| 4,157,784 | 6/1979 | Grottaup et al. | 283/79 |
| 4,588,211 | 5/1986 | Greene | 283/70 |
| 4,634,148 | 1/1987 | Greene | 283/70 |
| 4,642,526 | 2/1987 | Hopkins | 315/244 |
| 4,724,309 | 2/1988 | Greene | 235/468 |
| 5,456,498 | 10/1995 | Greene | 283/70 |

*Primary Examiner*—Harold I. Pitts

[57] ABSTRACT

This invention relates to novel checks that are coated in a particular way with invisible fluorescent-phosphorescent inks. As the check is processed, it is subjected to a source of an ultraviolet light and conventional light which illuminates the coated areas so that the check can be imaged and the ultraviolet light makes visible the phosphorescent-fluorescent ink so that designated areas are identified. The designated areas have a code in which the computer can determine the nature of the data within the fields. The above is utilized with novel check coatings that define the designated areas but without necessarily coating them.

13 Claims, 3 Drawing Sheets

COATINGS AND INK DESIGNS FOR NEGOTIABLE INSTRUMENTS

BACKGROUND OF THE INVENTION

The present invention relates to the machine readable documents designed for use in a document processing apparatus and, more particularly, checks for use with an image processing system that can perform proof of deposit, archival and retrieval of document functions without restricting the commonly accepted appearance of the documents or necessitating regulations pertaining to same.

In U.S. Pat. Nos. 4,588,211, 4,634,148 and 4,724,309, there are disclosed systems with which the documents of this invention can be used and the teaching of these patents are hereby incorporated by reference and comprise the principal prior art.

This invention incorporates certain inks with certain coatings, lighting, coating patterns that when used improves check processing transports and adds fraud detection capabilities. The whole is accomplished with a one-pass system through the check processing transport. The checks can be coded to instruct the processing equipment which particular features, if any, are included.

SUMMARY OF THE INVENTION

The present invention relates to machine readable documents designed for use in a document processing apparatus and, more particularly, to coating inks, patterns and lighting that enhance image processing systems that can perform proof of deposit, inventions, the negotiable instruments to be processed have selected field areas covered with a fluorescent ink with code means associated therewith that permit a scanning device to identify these field areas. The field areas are coated by an invisible fluorescent ink which will be excited when UV light is applied.

One check is designed so that the entire face (front) of the check is covered in a non-visible fluorescent ink except on lines that define generally rectangular boxes which circumscribe areas where variable data such as the signature, amount, and payee are entered. These variables can be entered in unknown locations on the check and be identified by code means in the same manner as the aforementioned patents. In this instant invention, the checks are readily digitized by an image capture apparatus as an entire document for archival and processing purposes and/or by selected variable fields, or snippets, which are captured and stored for further processing.

An objective of the present invention is to provide a wide range of negotiable instruments for use with an image capture apparatus of commercial transaction documents that utilize fluorescent inks, a phosphorescent component and UV light to enhance processing performance.

A principal objective of this invention is to provide a document or negotiable instrument that is selectively coated with a fluorescent ink in a manner so that processing equipment can image the entire check and, with the same light source, illuminate and identify the selectively coated areas so that the information in these areas can be independently captured and manipulated while the entire check can be imaged for archival and other purposes.

Another objective of the present invention is to provide a negotiable instrument wherein any selected area of a negotiable instrument of any size or shape can be machine read, captured and processed for payee, amount, signature, maker or any other field in a manner that the entire face of the check is imaged for archival purposes and yet the ability to located and image the field areas is preserved.

Another important objective of the invention is to use a UV light source and a white light source so that the check can be imaged as a whole and yet the processing equipment can preserve the ability to locate and identify selected field areas with a one-pass process throught the transport mechanism.

A still further objective of the invention is to provide a single light source combining UV and white light components in sufficient intensity to accomplish the other objectives herein stated.

It is a further objective of the invention to provide a negotiable instrument wherein non-visible inks, usually fluorescent, are mixed with a phosphorescent component.

The prior art is aware of fraud detection systems in which a fluorescent ink is used that has a selected emission wavelength when exposed to UV light. The emissions are directed to band-pass filters placed between the fluorescent coating and a detector device (sometimes an imager) so that negotiable instruments that are not coated with the proper fluorescent ink are rejected and routed to an area for further inspection.

A further objective of this invention is to provide a phosphorescent substance component to the fluorescent component which will enhance the anti-fraud technique capability of the coating ink as a whole.

A still further objective of this invention is to provide structure along the transport path of a check processing machine so that only a selected emission is accepted that works in combination with a phosphorescent component whose decay can be measured after the removal of a UV or other light source.

Another objective of this invention is to provide a pair of spaced silicon detectors along a check transport path which can measure the degree of decay of a particular substance on the check after the excitation energy has been removed.

A still further objective of the invention is to provide a machine readable code on the check that will inform the processing transport which features of this invention are included on the check.

Other objectives and advantages of the present invention will become apparent from the following detailed description of preferred embodiments taken in conjunction with the accompanying drawings.

DESCRIPTION OF THE PREFERRED EMBODIMENTS

Figure 1:
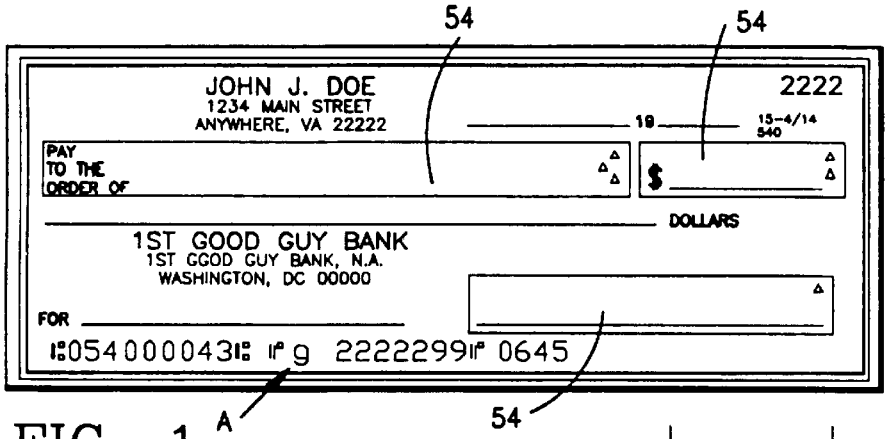
FIG. 1 (PRIOR ART)
FIG. 1 is a plan view of a prior art negotiable instrument.

Referring now to the drawings wherein like-numerals refer to like-parts, the numeral 10 refers generally to the processing and authenticating flow assembly of this invention. The processing system 10 is adapted to receive documents or checks 12 on which at least one area is coated with a substance emitting a particular spectrum of frequency when subjected to a particular energy source. For instance, fluorescent inks of a certain make-up will emit at a certain frequency which can be filtered.

In one known check transport assembly, pre-encoded documents 12 are placed in an automatic feed 14 where they are delivered into a document transport path 17. The pre-encoded documents can include checks having the bank ID number, the account number, the check sequence number, and the amount pre-encoded along the bottom edge (the MICR line) of the document. Many travelers checks and business checks are pre-encoded with the amount, but most consumer checks are encoded with the amount at the bank of first deposit.

Documents 18 which have not been encoded are fed to a coding station 20. Such documents as personal checks on which the amount must be encoded at the bank after receipt, are encoded at coding station 20 and thereafter delivered to the document transport 16. The document transport 16 carries the documents past a character recognition means 22. The character recognition means can be an optical reader designed to read an E 13 B, CMC, or similar font. The optical MICR (Magnetic Ink Character Recognition) or a magnetic MICR read head can be employed. As important as the advantage of this invention is, it is recognized that it will be many years before all checks incorporate the features of this invention. Therefore, it is recognized that all check processing transports, even those particularly designed for imaging, will not be equipped with either one or both the authenticator and decay detectors herein described. Thus, a code can be provided on checks that have one or more of the aforementioned features. The code will signal the transport by a code number that the transport should read which features are on the document to be processed. The location "A" on the check MICR line could indicate which ink, if any, has been utilized. The absence of a numeral can indicate that the check is uncoated and that the signals from the authenticator or the decay detectors should be disregarded. The numeral "8" could indicate that only the fluorescent component of the ink is used and that the authenticator 60–63 is not operable. The numeral "9" could indicate that the phosphorescent component is also used and that the results from the authenticator and the decay measuring detectors should both be heeded. If the banking community finds it is unacceptable to place such code in the MICR line, the code can be moved to an alternate machine readable location. The following description will include the major features and coatings.

The optical reader 22; that is, the character recognition means, scans the encoded characters on the document and produces visual recognition signals corresponding to each of the documents indicative of the encoded characters. These recognition signals are transmitted to a digital control computer 24. The computer 24 sends a signal responsive to the recognition signals which is ultimately received by a sorter 26. The sorter 26 contains a plurality of pockets in which documents may-be stored according to pre-selected criteria. The computer 24 can also send a signal to a reject pocket system 28. If the recognition signals corresponding to a particular document indicate nonrecognition, the unrecognized checks are routed to the reject pocket system 28.

An authenticator 60, is disposed along the path of transport 16. The authenticator is comprised of a band-pass frequency filter 61 and a detector 63. Detector 63 is adapted to accept or reject the emission spectrum from the selected fluorescent coatings on the document when subjected to a UV light source 65. These are well known to those skilled in the art. The authenticator detector sends a signal to the reject pocket 28 if the coating does not have the correct frequency emission characteristics. If the filter blocks the emission spectrum 58, this is detected by the detector 63 and the check is sent to the reject pocket 28. Thus, the rejected checks that find their way to pocket 28 can be investigated at a very early stage.

If the document is not sent to reject pocket 28 by the reader or authenticator, there is yet another safeguard provided. The coating ink 54 is not only fluorescent, but is laced with a sufficient amount of phosphorescent ink for purposes hereinafter described.

The UV light source 65 strikes the ink 54 and excites the coated areas 54. The emission wave length is controllable by the composition of the fluorescent material. For instance, if emission 58 has a wavelength of 500 nanometers, a band-pass filter 60 is disposed along the path of the emission 58 to permit only emissions of 500 nanometers, ±5 nanometers, to reach the detector 63. Sometimes the detector is an imaging device itself. Here, the detector and the imaging device are separated.

Figure 3:
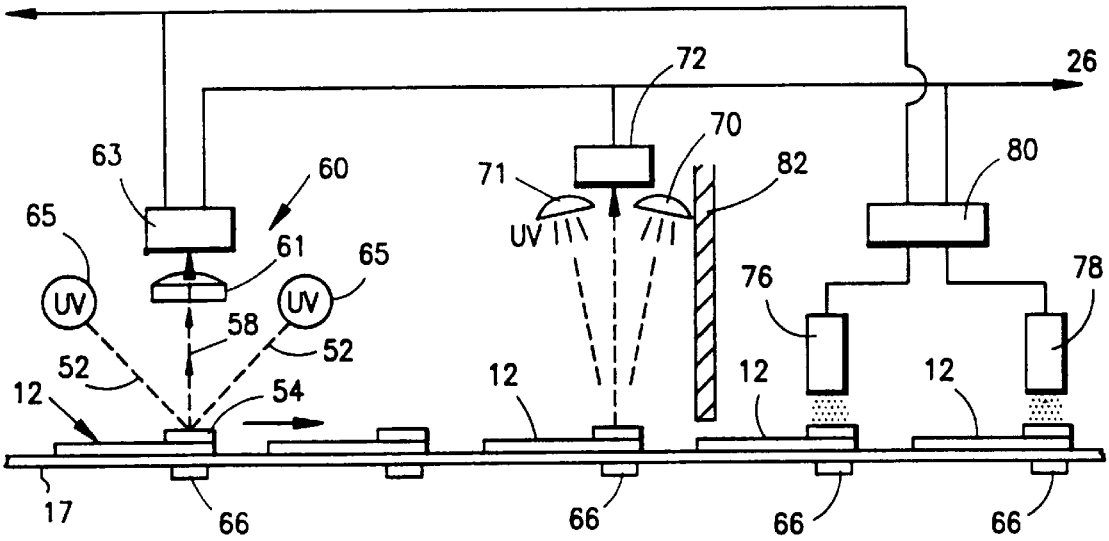
FIG. 3 is a diagrammatic side elevation showing an arrangement of major elements of the system for processing the checks of this invention along the processing transport path.

A series of micro-switches 66, or the like, diagrammatically shown in FIG. 3, are placed along the transport to detect the presence of a check at different locations as the document traverses the fraud prevention devices. The devices 66 can be micro-switches or any commonly used apparatus, such as an electric eye, to detect the presence or absence of an item.

A code, for instance, at "A", is provided to indicate if the check has been coated. If uncoated, the control system will pass the checks without subjecting them to the authentication checks. If coated with a fluorescent-phosphorescent ink, the checks will be subjected to both tests. When an improperly coated check passes below the authenticator, the detector 63 will not receive an emission stream. A signal will be sent to eject that check away from the main transport so that it can be examined more closely.

When a properly UV coated check 12 departs from the UV light source, it is subjected to a white light source 70 or a combined UV and white source. The illumination from the light source 70 is sufficient to permit the solid state line scan camera 72 to take an image of the check. The camera will also recognize the field area codes shown here as small triangles.

As stated above, the ink 54 is mixed with a phosphorescent material which can be excited by the UV light source and/or a white source or other light source. Phosphorescent materials are chosen that have a decay that can be carefully designed and measured. To measure this decay after the check has been removed from the light source, a pair of spaced silicon detectors 76 and 78 are disposed along the length of the transport device downstream of the light sources. As a check moves past detectors 76 and 78, the degree of decay is measured with respect to time. The detectors develop a voltage differential dependent on the phosphorescent emissions as they pass by the detectors which is measured by a voltage regulator 80. A light barrier 82 is disposed between the light sources and the decay detectors.

Figure 4:
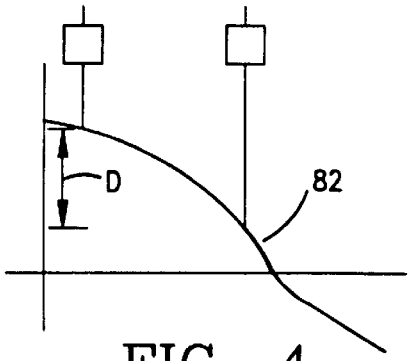
FIG. 4 is a graph showing a phosphorescent decay curve.

FIG. 4 shows a typical decay curve. The "X" axis is the point at which phosphorescent emissions commence and the interaction with the "Y" axis is there they cease. Phosphorescent emissions will decay along the curve 82. The difference in decay (D) is detected by the silicon detectors. Each detector develops its own voltage dependent on the emissions. Their voltages are compared by voltage regulator 80, and, if the decay does not correspond to the decay characteristics of the selected phosphorescent material, a signal is sent to the transport system and the check is rejected for further inspection.

After traversing these two authenticators, the check will be processed by an image count microfilmer means 30. The copy means 30 is preferably an image count microfilmer. The microfilmer 30 creates a permanent copy of the front and rear of all documents passing therethrough. The copies are then processed in a known fashion in a developer 32 and stored at 34. Whenever needed, these copies may be retrieved in a known manner by a microfilm retriever 36. The documents are then transported past a scanning means 38, which is preferably a solid state, line scan camera.

The scanner 38 scans the document and develops digital information signals therefrom. These information signals are transmitted-to the control 24. For example, on a check the scanner will scan the document and the system will locate the handwritten portion of the "Pay to the Order of" line, the signature line and the "Amount" area and, if desired, other field areas of the check document as explained in the aforementioned Greene patents. Note the coding, shown as triangles, on the field areas or snippets in each field area. These codes permit manipulation of these snippets as described and claimed in the aforementioned Greene patents. The documents are then transported to the sorter 26 where they are stored in preselected pockets. The control 24 stores the information contained in the recognition signals from the optical reader 22 and the information signals received from the scanner 38 on an output medium. The output medium may be magnetic tape 42, a magnetic disc, CD ROM, or the like. This output record is delivered to the existing central processing system 46 (CPS). The image data obtained via the information signals from the scanner 38 and the recognition date obtained via the recognitions signals from the optical reader 22, relative to the ON-US checks only, are cycle-sorted onto the storage media. At cycle time, the accumulated files are reentered to a random access device and are sorted by account number sequence within the zip code and by check sequence number within the account. The structured files are then merged with a master file and a history file to generate a statement file. The entire function takes place within the CPS, which is denoted as already existing within the user system by dotted lines 44. The statement generator 40, which can be a separate PC, receives an output from the CPS 44 to create a microfilm image or a microfiche and a hard copy statement of the account. The statement generator 40 can be one of a number of known prior art devices classified as computer output microfilmers, film-to-paper devices or laser printers.

As seen, the authenticator filter assembly 60–63, and the camera scanner 72 are located along the processing path. The invention is represented by the numeral 110, shown at FIG. 5. The front face of the check is indicated by the numeral 112. As can be seen, commonly used checks such as that shown in FIG. 5 will normally have the account owner's name 114, a date line 116, a payee line 118, an amount line 120 and a courtesy amount line 122. There is oftentimes other information but those listed are common and sufficient to demonstrate the usefulness of the coating patterns hereinafter described.

Figure 6:
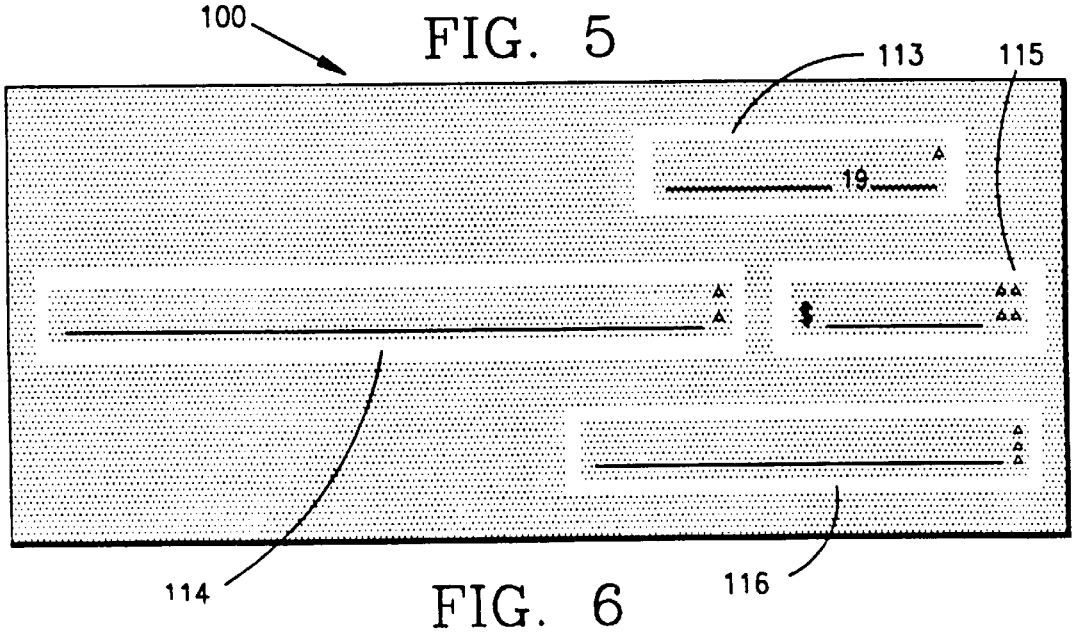
FIG. 6 is a view showing an entire check covered by the inks of this invention except for a border about field areas.
Figure 7:
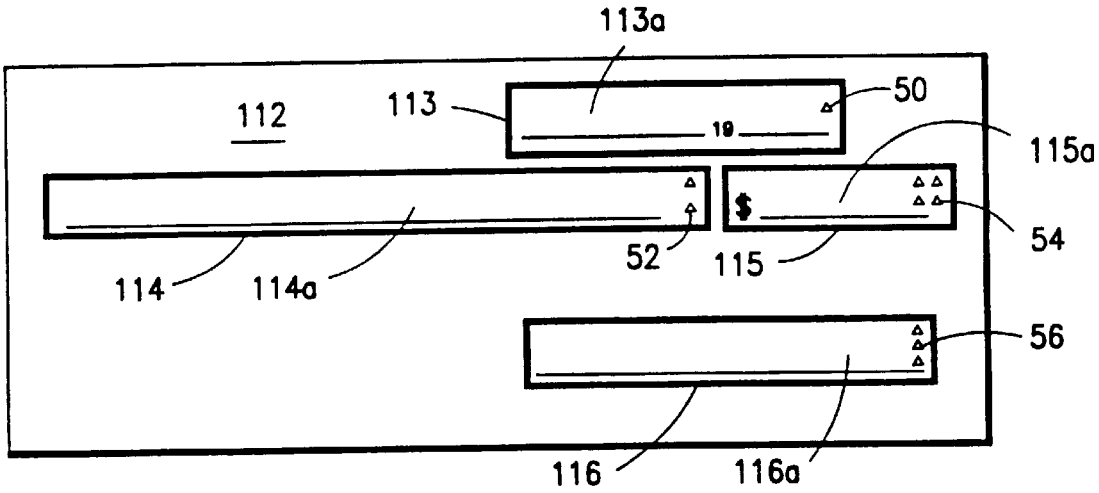
FIG. 7 shows the document of FIG. 6 when the document is exposed to UV light.

As seen in FIG. 6, the entire Face 112 is coated with the inks of this invention (when used herein non-visible means generally invisible to the naked human eye) except along rectangular border patterns 113, 114, 115 and 116 which, respectively, circumscribe rectangular field areas 113*a*, 114*a*, 115, and 116*a*. Variable information is applied in these areas by the check user. In many cases, the field areas are the signature area, a payee area, a courtesy amount area, and the date area. As stated above, in this embodiment, the borders represent the absence of a non-visible fluorescent ink. FIG. 7 depicts what the imaging device sees when the check of FIG. 6 is bathed with UV light. The absence of ink will show up as dark lines. The variable data (such as the signature shown) will also be visible because the ink within the field area has been covered with the variable data.

Figure 5:
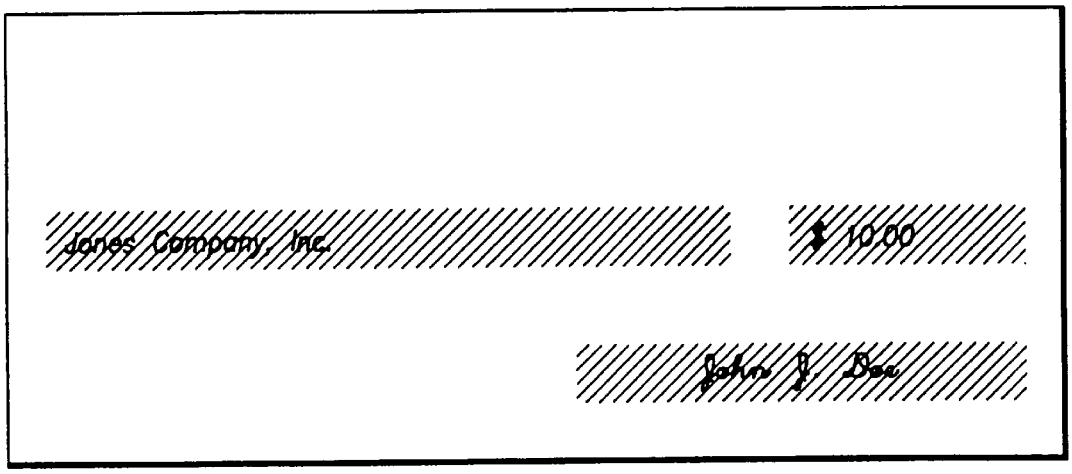
FIG. 5 is a plan view of the prior art check of FIG. 1 with areas selectively covered with a fluorescent ink in the manner shown by the above three identified prior art patents viewed under the lights of this invention.
Figure 8:
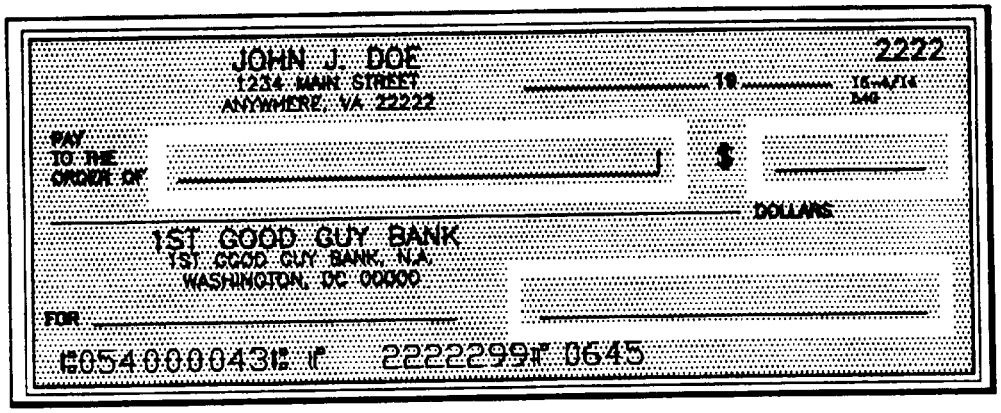
FIG. 8 is a plan view of a check with an invisible ink border coating which is shown by stippling for ease of understanding.

In FIG. 8, there is shown a check similar to that shown in FIG. 5 but with only the border lines coated by the fluorescent invention is represented by the numeral 110, shown at FIG. 5. Here, as in the aforementioned Greene patents, the ink is placed only over certain defined field areas. The front face of the check is indicated by the numeral 112. As can be seen, commonly used checks such as that shown in FIG. 5 will normally have the account owner's name 114, a date line 116, a payee line 118, an amount line 120 and a courtesy amount line 122. There is oftentimes other information but those listed are common and sufficient to demonstrate the usefulness of the coating patterns hereinafter described.

As seen in FIG. 6, the entire face 112 is coated with the inks of this invention (when used herein non-visible means generally invisible to the naked human eye) except along rectangular border patterns 113, 114, 115 and 116 which, respectively, circumscribe rectangular field areas 113*a*, 114*a*, 115, and 116*a*. Variable information is applied in these areas by the check user. In many cases, the field areas are the signature area, a payee area, a courtesy amount area, and the date area. As stated above, in this embodiment, the borders represent the absence of a non-visible fluorescent ink. FIG. 7 depicts what the imaging device sees when the check of FIG. 6 is bathed with UV light. The absence of ink will show up as dark lines. The variable data (such as the signature shown) will also be visible because the ink within the field area has been covered with the variable data.

Figure 9:
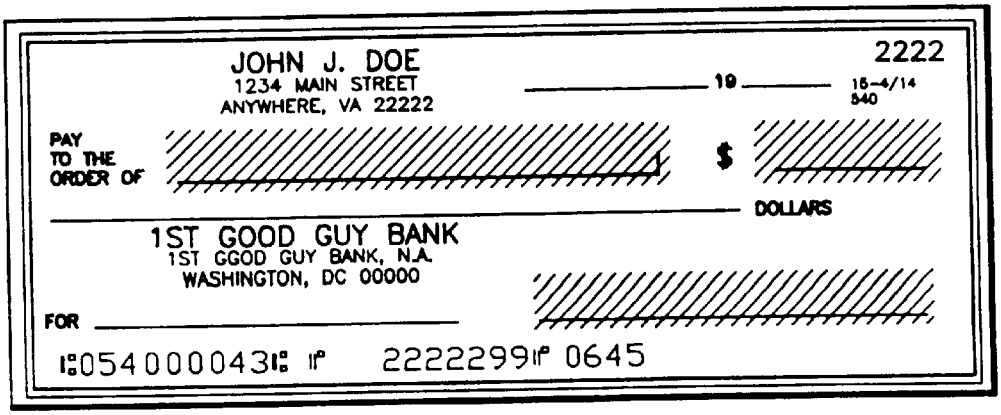
FIG. 9 is a view illustrating what a camera will see when the document of FIG. 8 is exposed to UV and white light.

In FIG. 8, there is shown a check similar to that shown in FIG. 5 but with only the border lines coated by the fluorescent ink. When subjected to a combined white and UV light source, the image capture device will see the FIG. 9 presentation. Thus, both the check and the field areas are detectable. With the binary code in each field area identifying the subject matter within each field area, the software associated with the imaging device can manipulate this data as necessary. At the same time, since the entire check is illuminated, a full image can be taken for archival purposes either simultaneously or sequentially. There has been shown, several independent coating patterns; namely, borders formed by an absence of fluorescent ink (FIG. 5), and the borders formed by the ink. In both instances, a joint light source (white and UV) will permit the entire check to be imaged while preserving the ability to code and independently manipulate the information within in the various field areas and not detract from any of the other advantages stated.

Figure 2:
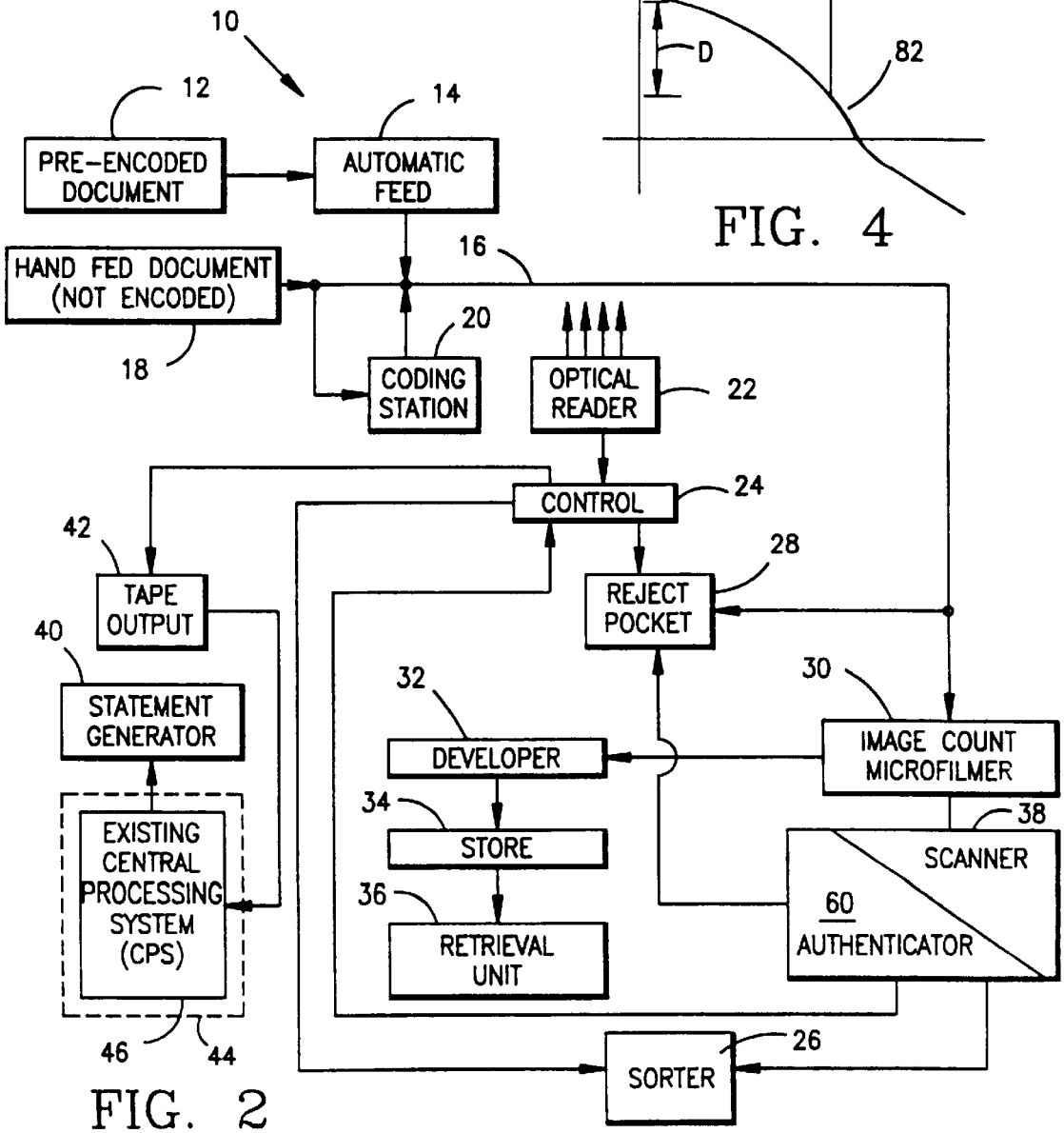
FIG. 2 is a diagrammatic-schematic view of a check processing transport assembly.

Within the type of transport shown in FIG. 2, there is an imaging station. FIG. 3 is a diagrammatic representation of an imaging station for a transport processing machine which can be used with the negotiable instruments of this invention with little alteration other than the addition of a UV light source with a white light illumination source either simultaneously or sequentially.

As seen in the drawings, a check 112, having a coating 154 thereon, is subjected to a UV light 140 so that the band-pass filter 142 and detector 144 can determine whether the check is coated with the proper ink. The check then proceeds to the composite light sources 146 and 148 which are, respectively, UV and a conventional light source.

In the FIG. 8 and FIG. 9 embodiment, the entire face of the check will be illuminated for imaging and the variable data entered within the field areas circumscribed or defined in the various coating arrangements described above.

The non-visible fluorescent portion of the ink will define generally rectangular areas which, when scanned under UV light, will highlight the location of the variable data and the white light will automatically illuminate the entire check for imaging. Thus, the check can be processed in a one-pass operation and can be processed by conventional imaging assemblies or by those improved as described above.

After passing the authenticators, the checks of the type depicted are transported past the scanning apparatus 44 which is preferably a solid state CCD camera of the type manufactured by Dalsa, Inc. The scanner is set to capture an analog picture of the entire check during illumination by the UV and white light source. The entire face of the check is captured and digitized. The digital record is stored in an industry standard TIF file format, and because the field areas are recognizable and coded, the information therein can be digitally recorded and independently manipulated. These discreet fields can subsequently be processed as individual fields or as an entire record including the name of the payor bank, maker's name, address and any other information outside of the discreet information fields.

The fluorescent-phosphorescent inks are substantially invisible to the naked eye under conventional light. The check 112 will appear conventional to users, bank customers and bank processing machines in conventional white light. However, when the check is passed below a composite light source, the entire check will be illuminated and the field areas will be depicted and recognizable. Any written indicia within the area that has been added over the ink, or information written or printed thereon, such as the maker's name and address, will be black by comparison with the fluorescent background area(s) when exposed to UV light. (In those instances where the field area is coated.) In all instances, a distinct contrast is provided which facilitates image capture by a scanning apparatus.

In the FIGS. 8–9 embodiment, the narrow lines of fluorescent ink are printed on the check that circumscribe or define the rectangular field areas which areas depict information such as payee, amount, date, signature or memo field. This check is first scanned under UV light. The fluorescent ink will illuminate the zone or zonal border to be identified which contain variable data, usually written, indicia. By code means 50, 52, 54 and 56, the scanning apparatus can determine the exact location of each field so that the variable written information in the field(s) is automatically extracted and recognized by prior art host computers that can interpret machine generated, hand printed or handwritten variable information. Although shown only in the check representations of FIGS. 6 and 7, it should be understood that all checks using the systems herein described will have codes, such as 50–56, either within or without the field areas, to tell the processing controls the identity of each field area. The codes are not on several of the representations solely for purposes of simplicity. Also, there is great demand for the space "A" on the MICR line. This space is vacant at the present time. It should also be understood that a code indicating the nature of the coatings (or absence thereof) could take another form or be at a different location.

The field area codes are shown in this description in a variety of fashions. In the aforementioned Greene patents they are disclosed as readily recognized binary symbols. However, other code symbols could be used; e.g., the "$" sign on-most checks could be used to identify the courtesy amount field area.

The checks and other negotiable instruments printed with the inks described can be simultaneously processed on a bank check processing apparatus such as an AT&T 7780 or Unisys DP-500 document image processor equipped with a UV light source and one or more cameras to capture information from the check.

In describing the invention, reference has been made to preferred embodiments and illustrative advantages of various features of the present invention. Although the check coating patterns and inks are new and useful in themselves, the processes and equipment used therewith are also new and useful in themselves and also in combination with the patterns. Those skilled in the art, however, and familiar with the instant disclosure of the subject invention may recognize additions, deletions, modifications, substitutions and/or other changes without departing from the scope of the instant invention and appended claims.

What is claimed is:

1. A negotiable instrument operable for automatic bank scanning and processing comprising:

planer member of generally rectangular configuration having a width and height and bank identification information printed thereon;

a field area for receiving a date of making said negotiable instrument on one side thereof;

said planer member further having a second field area on said one side for receiving indicia designating a maker of the negotiable instrument;

said planer member having a third field area on said one side for receiving indicia designating a payee of the negotiable instrument and said planer member having a fourth field area on said one side for receiving a numeric amount of said negotiable instrument; and ink applied as a background upon said negotiable instrument within at least one of said first, second, third, and fourth field areas;

said ink having a fluorescent component and a phosphorescent component and said ink being operable for receiving visible indicia placed within said at least one of said first, second, third, and fourth field areas and upon said fluorescent ink means background, said ink means being further operable for selectively permitting a scanner to read the said at least one of said first, second, third, and fourth field areas of the negotiable instrument and for optically rendering indicia placed upon the fluorescent ink means background readable by a scanning apparatus directing ultraviolet light onto said negotiable instrument wherein information located within said at least one of said first, second, third, and fourth field areas, regardless of location on the negotiable instrument, may be automatically detected and scanned;

said fluorescent component having a known frequency emission spectrum when exposed to ultraviolet light;

an ultraviolet light source directed at said coating for actuating an emission of a particular frequency spectrum along a path;

a band-pass filter disposed in said path of said emission between said coating and said detector for blocking emissions that are not in said frequency spectrum;

a white light source directed at said coating for exciting said phosphorescent component;

a pair of spaced detectors that measure the rate of decay of said phosphorescent component when moved therepast; and means for signaling said operator when said detectors do not recognize said frequency or said rate of decay.

2. The negotiable instrument of claim 1 wherein said ink is coated throughout said check except in said field areas.

3. The negotiable instrument of claim 1 wherein said ink is in the form of a border about said field areas.

4. The instrument of claim 1 wherein said emission frequency is 522 nanometers and said range is from 517 to 527 nanometers.

5. The instrument of claim 1 wherein the decay phosphorescent component is selected to have a measurable rate over a 0.03 second period.

6. A financial instrument having a plurality of field areas on a planer surface thereof, a fluorescent ink covering said planer surface except for a border area surrounding at least one of said field areas.

7. The financial instrument of claim 6 wherein said fluorescent ink covers said planer surface except for a border area surrounding each of said field areas.

8. The financial instrument of claim 7 wherein said ink includes a phosphorescent component.

9. The financial instrument of claim 8 wherein a code is associated with each of said field areas.

10. A financial instrument having a plurality of field areas on a planer surface thereof, comprising a fluorescent ink on said planer surface defining a rectangular border surrounding at least one of said field areas.

11. The instrument of claim 10 wherein said fluorescent ink defines a rectangular border surrounding a plurality of said field areas.

12. The financial instrument of claim 11 wherein said ink includes a phosphorescent component.

13. The financial instrument of claim 12 wherein a code is associated with each of said field areas.

* * * * *